US008784949B2

(12) United States Patent
Reichen et al.

(10) Patent No.: US 8,784,949 B2
(45) Date of Patent: Jul. 22, 2014

(54) REMOTE NON-THERMAL ATMOSPHERIC PLASMA TREATMENT OF TEMPERATURE SENSITIVE PARTICULATE MATERIALS AND APPARATUS THEREFORE

(75) Inventors: Patrick Reichen, Wil (CH); Axel Sonnenfeld, Zürich (CH); Philipp Rudolf Von Rohr, Muttenz (CH)

(73) Assignee: Eidgenossische Technische Hochschule Zurich, Zurich (CH)

( * ) Notice: Subject to any disclaimer, the term of this patent is extended or adjusted under 35 U.S.C. 154(b) by 970 days.

(21) Appl. No.: 12/808,898

(22) PCT Filed: Dec. 17, 2008

(86) PCT No.: PCT/EP2008/067775

§ 371 (c)(1),
(2), (4) Date: Nov. 1, 2010

(87) PCT Pub. No.: WO2009/080662

PCT Pub. Date: Jul. 2, 2009

(65) Prior Publication Data

US 2011/0039036 A1 Feb. 17, 2011

(30) Foreign Application Priority Data

Dec. 20, 2007 (EP) ..... 07024726

(51) Int. Cl.
*H05H 1/24* (2006.01)

(52) U.S. Cl.
USPC ..... 427/569; 427/213; 427/578; 118/716; 118/723 E; 118/723 MP; 118/723 R

(58) Field of Classification Search
CPC ..... C23C 16/442; C23C 16/50; H05H 1/24; H05H 1/2406; H01J 37/32009; H01J 37/32348; H01J 37/32568
USPC ..... 427/213, 569, 578; 118/716, 723 E, 118/723 MP, 723 R
See application file for complete search history.

(56) References Cited

U.S. PATENT DOCUMENTS

| | | | | |
|---|---|---|---|---|
| 4,221,182 | A * | 9/1980 | Brown | 118/716 |
| 5,234,723 | A * | 8/1993 | Babacz | 427/491 |
| 2003/0116091 | A1 * | 6/2003 | Grant et al. | 118/726 |
| 2006/0257299 | A1 | 11/2006 | Lanz | |
| 2008/0248306 | A1 * | 10/2008 | Spillmann et al. | 428/403 |

FOREIGN PATENT DOCUMENTS

| | | | |
|---|---|---|---|
| EP | 1 777 302 | A1 | 4/2007 |
| WO | WO 2005039753 | * | 5/2005 |
| WO | 2005/076673 | A1 | 8/2005 |
| WO | 2007/036060 | A1 | 5/2007 |
| WO | 2007/067924 | A2 | 6/2007 |

OTHER PUBLICATIONS

C. Arpagaus et al., "Short-time plasma surface modification of HDPE powder in a Plasma Downer Reactor-process, wettability improvement and ageing effects", Applied Surface Science, Elsevier Netherlands, Dec. 15, 2005, pp. 1581-1595, vol. 252, No. 5.

* cited by examiner

*Primary Examiner* — Elizabeth Burkhart
(74) *Attorney, Agent, or Firm* — Sughrue Mion, PLLC

(57) ABSTRACT

The present invention relates to a novel process for the remote plasma surface treatment of substrate particles at atmospheric pressure. The invention is motivated by the urge to overcome major drawbacks of particle treatment in low pressure plasmas and in-situ particle treatment at atmospheric pressure. The former requires complex and mostly expensive vacuum installations and vacuum locks usually prohibiting continuous processing. Independent of the system pressure, in-situ plasma treatment causes particle charging and therefore undesirable interaction with the electric field of the discharge, which is seen to contribute to the process of reactor clogging. Additionally, the filamentary discharges modes of atmospheric pressure plasmas are inflicted with inhomogeneous surface treatment. Furthermore, short radical lifetimes at elevated pressures complicate a remote plasma treatment approach as widely used in low pressure applications. The key-element of the invention is that by reducing the dimension of the atmospheric discharge arrangement to the micrometer range, transonic flow conditions can be achieved in the discharge zone while maintaining moderate flow rates. The resulting superimposition of high drift velocity in the gas flow and the inherent diffusion movement is to prolong the displacement distance of activated species, thus making a remote plasma treatment of substrate particles feasible and economically interesting. The circumferential arrangement of e.g. micro discharge channels around the treatment zone of variable length allows a remote plasma treatment independently of the discharge mode and benefits additionally from the aerodynamic focusing of a particle-gas stream to the center, reducing reactor clogging. Furthermore, taking advantage of non-thermal discharges, there is no restriction of the concept of the outlined invention in the material properties of the particulate solids especially not with regard to the treatment of temperature sensitive materials as often encountered in polymer or pharmaceutical industries. In conclusion, atmospheric pressure plasma treatment close to ambient gas temperature as well as continuous processing is a specialty of the invention disclosed here.

26 Claims, 3 Drawing Sheets

REMOTE NON-THERMAL ATMOSPHERIC PLASMA TREATMENT OF TEMPERATURE SENSITIVE PARTICULATE MATERIALS AND APPARATUS THEREFORE

DESCRIPTION OF THE INVENTION

The present invention relates to a continuous process for surface modification by remote plasma processing of temperature sensitive particulate material at atmospheric pressure using a non-thermal discharge plasma. It furthermore relates to a device for carrying out such a process.

BACKGROUND AND STATE OF THE ART

Most of the applied plasma processes for surface modification and layer deposition still suffer severe constrains as the need for low pressure environment and the difficulty for easy scale-up rules that hinder their full deployment in industry. For this reason, researchers turned towards the restriction of applied plasma processes to low pressure in the early 90's by choosing the old-fashioned silent discharge, today mostly referred to as barrier discharge (BD). This non-thermal atmospheric pressure discharge was firstly applied by Siemens in his ozonizer in 1857. In recent years, this discharge type among others gained more and more attention due to the prospect of performing plasma processes usually done at low pressure at a much faster rate and without the need for expensive vacuum systems.

Of all different types of atmospheric discharges that have widely been explored, the non-thermal plasma of the BD, proved to be the most promising candidate for the treatment of temperature sensitive materials. The unique property of a non-thermal plasma is that the main constitutes, i.e. neutrals, ions and electrons, are not in thermal equilibrium, thus only electrons have mean energies of 1-10 eV whereas the overall gas temperature is close to ambient (typically around 300 K). Nevertheless, the energy of the high energetic electrons is still sufficient to initiate chemical reactions in the gas phase.

BDs have been applied in various fields such as exhaust gas purification, surface treatment or film deposition. Due to their spatial limitation to the millimeter and sub millimeter range, they appear to be beneficial for the treatment of inner surfaces of micro-structured devices as well as for the up-coming technology of plasma printing.

In plasma surface processing, BD's have primarily been applied to flat substrates of macroscopic work pieces. Otherwise, however, processing of particulate solids, i.e. granules and powders, is likely to be the most important operation in industrial production. This is most evident in chemical or pharmaceutical industry, where typically 80% of the intermediates and the majority of final agents are in solid state. Also, the polymer and plastic processing industries deal primarily with powders and granulates in the range from tens of micrometers to several millimeters. In the past, few methods have been proposed to treat powders adequately at atmospheric pressure. Recently, a device has been disclosed (DE102004048410) that allows the horizontal transport of a powder by a vibrating conveyor plate through the active zone of a filamentary surface discharge at atmospheric pressure, where silicon oxide-like material is deposited on the powder particles. A vertical, narrow-gaped BD arrangement was also reported to treat polymer particles in-situ, which means that the particles are in direct contact with the electric discharge. In both cases, filamentary discharge patterns are presumably responsible for an inhomogeneous surface modification. Such a dispersed spatial formation is the common discharge mode of an atmospheric BD. In fact, it consists of a multitude of individual discharge channels (filaments) with typical lifetimes of around 1-100 ns and radial extension of about 100 μm resulting in the aforementioned inhomogeneity of the plasma treatment. The urge to avoid inhomogeneous treatment has provoked the promising though sophisticated approach to generate so-called Atmospheric Pressure Glow Discharges (APGD), the homogeneous mode of BD. They are though very delicate with respect to their domains of existence. So far, APGDs were found to be restricted to pure nitrogen or noble gases, e.g. helium.

Since most non-equilibrium atmospheric plasmas, and especially BDs, are constricted to narrow geometries, in-situ treatment of particulate solids is tied to some major drawbacks such as uneconomically small through-put, clogging due to particle agglomeration caused by e.g. thermal hotspots or particle charging in the plasma, and substrate heating through ion bombardment in the plasma phase (important issue for temperature sensitive materials).

DISCLOSURE OF THE INVENTION

The objective of the present invention is to overcome the disadvantages of the prior art and to provide an economic, remote plasma process for particle surface modification at around atmospheric pressure for different particulate bulk solids of temperature sensitive materials.

In the past, few methods have been proposed to treat powders adequately at atmospheric pressure. Nevertheless, some major problems such as particle-plasma interactions resulting in undesired particle depositions and inhomogeneous surface treatment in filamentary discharges have not been solved yet. Furthermore, powder conveying without elaborate dispersion systems additionally endanger homogenous particle treatment due to agglomeration and the formation of clusters.

The solution presented here is the separation of the discharge region, where the active gas species are generated, and the treatment zone of substrate particles, in which the chemical reactions of the active species with the particle surface occur. This remote technique provides less dependency of the discharge mode, i.e. filamentary or glow discharges, since for the surface treatment only the final concentration of the emerging radicals and their chemical composition is important. Consequently, the key issue that must be addressed here is the transport of radical gas species from the plasma to the treatment zone since the travel distance of active species is strongly limited by their very short lifetimes at ambient pressure. To overcome such restrictions, we propose a specific geometrical set up as well as to apply high gas velocities in order to enlarge the displacement distance of these species. By constraining the plasma to the micrometer range, transonic flow conditions can be reached and at the same time the process gas consumption minimized.

Based on that, we present a new process and reactor concept applying non-thermal micro barrier discharges (μ-BD). For a lab scale plasma treatment device and equally to an industrial device, a multitude of single micro-channels are circumferentially arranged around a (vertical) reaction zone (henceforth called treatment zone), wherein the substrate particles would be treated by the activated species emerging from a surrounding array of μ-BD channels. This concept further prevents the substrate particles from being attached to the reactor walls.

The present invention thus relates to a novel process for the remote plasma surface treatment of substrate particles at atmospheric pressure. The invention is motivated by the urge to overcome major drawbacks of particle treatment in low pressure plasmas and in-situ particle treatment at atmospheric pressure. The former requires complex and mostly expensive vacuum installations and vacuum locks usually prohibiting continuous processing. Independent of the system pressure, in-situ plasma treatment causes particle charging and therefore undesirable interaction with the electric field of the discharge, which is seen to contribute to the process of reactor clogging. Additionally, the filamentary discharges modes of atmospheric pressure plasmas are inflicted with inhomogeneous surface treatment. Furthermore, short radical lifetimes at elevated pressures complicate a remote plasma treatment approach as widely used in low pressure applications. One important aspect of the invention is that by reducing the dimension of the atmospheric discharge arrangement to the micrometer range, high gas velocities up to transonic flow conditions can be achieved in the discharge zone while maintaining moderate flow rates. The resulting superimposition of high drift velocity in the process gas flow and the inherent diffusion movement is to prolong the displacement distance of activated species, thus making a remote plasma treatment of substrate particles feasible and economically interesting. The circumferential arrangement of e.g. micro discharge channels around a treatment zone of variable length allows a remote plasma treatment independently of the discharge mode and benefits additionally from the aerodynamic focusing of a particle-gas stream to the centre, reducing reactor clogging. The circular arrangement of (process gas) flow channels directed to the central axis of the treatment zone leads to an enveloping or enwrapping of the substrate particle loaded carrier gas stream preventing contact with the walls of the treatment zone (e.g. by means of a multitude of concentric, symmetric channels in one or several planes all focusing to the axis). The treatment zone can be a vertical linear pathway allowing an essentially gravity-based transport (further assisted by an additional carrier gas flow if needed) of the substrate particles carried by the carrier gas stream through the treatment zone. Furthermore, taking advantage of non-thermal discharges, there is no restriction on the material properties of the particulate solids being processed according to the concept of the outlined invention—especially not with regard to the treatment of temperature sensitive materials as often encountered in polymer or pharmaceutical industries. In conclusion, atmospheric pressure plasma treatment close to ambient gas temperature as well as continuous processing is a specialty of the invention disclosed here.

In the following, different general terms are introduced as to define their meaning for all descriptions throughout this document.

Treatment: considers the following three plasma chemical processes without changing the bulk properties of the substrate material: a) the modification of particulate surfaces with excited species; b) the plasma chemical deposition of films by addition of a monomer; c) precipitation of nanoparticles in the gas phase for their simultaneous attachment to the substrate surfaces.

After glow: Downstream of the plasma region where external electromagnetic fields that sustained the plasma are absent or insufficient to maintain the discharge. The afterglow begins where recombination processes exceed the generation of free electrons. Thereafter, the region is mainly characterized by the presence of remaining active species that are decomposed by chemical reactions (e.g. with surfaces or other molecules).

Carrier gas: is used to address a gas stream, which is used to disperse the substrate particles and to transport them through the treatment zone. The carrier gas is thus not in direct contact with the plasma of the electric discharge. Though, its constituents may be involved in physical as well as chemical processes initiated by active species generated in the discharge. Optionally, a monomer (i.e. a chemical compound to initiate homogeneous as well as heterogeneous reactions towards solid formation) can be added depending on the desired surface treatment Process gas: In contrary to the carrier gas, the process gas is at first partially ionized in a non-thermal atmospheric pressure discharge prior its expansion into the treatment zone. Consequently, when leaving the active discharge zone, due to direct as well as to secondary reaction processes, it is enriched by chemically excited as well as physically exited species, e.g. radicals and metastable molecules and/or atoms. The carrier gas and the process gas can either descent from the same gas-mixture or differ quantitatively as well as qualitatively in their composition. Optionally, a monomer (see above) could be added to the process gas stream.

Treatment zone: confined volume in space where the carrier gas and the process gas admix and the said treatment occurs.

Plasma zone: confined volume in space, in which the plasma is generated by applying preferentially a homogeneous electric field of high intensity to activate plasma chemical reactions and where the process gas passes through.

Substrate particles: are solid particles of any material, which are treated with the present method. There are not subject to any limitation in terms of e.g. particle size distribution, shape, physical properties (e.g. conductive or non-conductive). Their size (typically average diameter or median diameter) is preferentially in the range between 0.1 μm and 10 mm, however, the particle sizes are preferable below 1 mm in diameter. Also nanoparticles can be treated.

Generally speaking, the invention thus relates to a remote plasma process for the treatment of particulate materials and an apparatus therefore comprising:

a) The mixing of a process gas and a carrier gas in the treatment zone, whereas the process gas stream is enriched by excited gas species and the carrier gas loaded with substrate particles.

b) The application of an electrical gas discharge for the creation of a non-thermal plasma at atmospheric pressure or near the same whereof the electrons being used to generate active species (e.g. ions, excited neutrals) in the process gas.

c) The superimposition of high velocities (drift) upon the process gas stream in order to prolong the displacement distance of excited species and thus, enlarge the afterglow region of the said atmospheric plasma.

d) That the zone/phase of the substrate particle treatment is spatially and temporally separated from the production of said excited species (remote treatment).

e) The process of a homogenous, chemical reaction of the excited species on the surface of the substrate particles in the said treatment zone.

In other words a remote plasma process for the treatment of particulate materials is proposed comprising at least the following steps:

mixing of a process gas stream and a carrier gas stream in a treatment zone, wherein the process gas stream entering the treatment zone is enriched by excited gas species and wherein the carrier gas stream entering the treatment zone is loaded with substrate particles. An electrical field is applied to the process gas stream prior to its entrance into the treatment zone for the creation of a non-thermal plasma at atmospheric pressure or near the same. The discharge is used to generate active species (e.g. ions, excited neutrals) in the process gas stream and high velocities (drift) are superimposed upon the process gas stream in order to prolong the displacement distance of the excited species and thus, enlarge the afterglow region of the said atmospheric plasma, essentially for allowing as many excited species as possible carried in the process gas stream to the treatment zone and therefore to the substrate particles.

The treatment zone (phase) of the substrate particles is preferably spatially and temporally separated from the production of said excited species i.e. the treatment zone and/or the treatment phase is located in the afterglow of the non-thermal plasma or downstream of this region where a homogenous chemical reaction of the excited species and/or of reactive species generated by the excited species in the treatment zone on the surface of the substrate particles can take place.

Typically, the substrate particles remain in the treatment zone for the required time scale to be modified by the activated species. For processes with slow surface reactions involved, long residence time can be achieved in drum reactors or fluidized bed reactors. Generally, the substrate particles can be fed to the treatment zone either batchwise or continuously (down stream reactors). It is also possible to carry the substrate particles periodically through the treatment zone (e.g. circulating fluidized bed reactor).

According to the preferred embodiment that resembles a down stream reactor design, the species, which are produced in the plasma zone, are transported by the process gas flow at a mean velocity in the range of 1 to 300 m/s within the plasma zone and/or from the plasma zone to the treatment zone. Preferably the mean velocity of the process gas flow in these regions is in the range of 5 to 200 m/s and more preferably in the range of 20 to 100 m/s. The gas velocities given above typically occur towards the end of the active plasma zone, in particular at the end of the process gas channels, which also corresponds to the point of entrance into the treatment zone. The spatial velocity distribution and the acceleration of the process gas along the axis of the channel, which contains the plasma zone, strongly depend on its geometry and the flow conditions in the total system. In the latter case, the relative pressure difference over the plasma zone is an important characteristic for the enforcement of the abovementioned velocities. Typically, this pressure difference is larger than 10 mbar, preferentially larger than 30 mbar, and for achieving truly high velocities; pressure differences of more than 0.5 bar are possible. The upper pressure limit is essentially given by reaching critical conditions in the channel.

According to a further preferred embodiment, the gas velocity is achieved by restricting the plasma zone to the millimeter, preferably to the micrometer range, wherein preferably the plasma zone is confined to at least one slot or channel of height in the range of 100 μm-1 mm, which is measured in the direction perpendicular to the planes of the electrodes and corresponds to the characteristic dimension of the plasma, and/or to at least one channel with such a height and a width (measured in a direction essentially parallel to the plane of the electrodes of the plasma device) in the range of 100 μm-10 mm, preferably from 0.5 mm to 5 mm.

Preferentially, the non-thermal plasma is generated by a barrier discharge, corona discharge and/or a micro hollow discharge.

The voltage signal for the plasma generation is either direct current (DC) or alternating current (AC). In the latter case, the frequency can vary from the low frequency to the radiofrequency range, preferably in the range of 500 Hz-20 MHz, more preferably in the range of 1 kHz-20 kHz. The higher the driving frequency, the higher is the power coupling into the discharge volume, i.e. into the process gas flow. However, the device might necessitate internal cooling at frequencies above 20 kHz. The power consumption per channel at a frequency of 1 kHz is typically in the range of 0.1-0.8 W but strongly depending on the channel dimension, the frequency, and the voltage applied.

As concerns the applied voltage for the generation of the plasma, the excess voltage $U_e$, which is the difference between the applied voltage $U_{app}$ and the minimum voltage required to ignite a plasma (often also referred to as plasma burning voltage $U_b$), is chosen to be as high as possible. The upper limit is given by the electrical strength of the device and/or when arching problems occur. Typically, an excess voltage in the range of 0.2-20 kV is chosen, preferably in the range of 1-10 kV.

According to another preferred embodiment, the mean operating pressure inside the plasma zone is in the range from 0.5 to 50 bar. The mean operating pressure inside the treatment zone is preferably in the range from 0.1 to 10 bar, more preferably around atmospheric pressure.

According to a further preferred embodiment, the substrate particle loaded carrier gas stream is guided along a preferentially vertical axis through the treatment zone. On the other hand, the process gas stream enriched by excited species is guided to the treatment zone from a direction essentially perpendicular to said axis in a converging manner, wherein preferably the total gas flow is split into a multitude of smaller process gas streams and then introduced into the treatment zone. This means that in one plane perpendicular to said axis, a large number of channels are arranged in radial but also in axial direction defining the flow path of the process gas streams and the direction of these gas jets into the treatment zone. Also possible is an oblique conical introduction of the process gas stream slightly from above, e.g. under an angle of 30-90° to the axis of the treatment zone. So, as the carrier gas is moving through the treatment zone, several surrounding process gas streams impinge onto it.

Preferably, the process gas stream is guided in an essentially circumferential and circularly symmetric manner in at least one plane perpendicular to said axis to the treatment zone. A multitude of such essentially circumferential process gas streams can be introduced into the treatment zone in several planes or layers distanced from each other along said axis.

The process gas stream can be guided to the treatment zone through at least one channel, preferably through a multitude of symmetrically arranged channels located in a plane perpendicular to said axis, wherein preferably a multitude of such planar arrangements of channels is arranged in several planes distanced from each other along said axis.

The present invention further relates to a device for conducting processes as given above, comprising of at least one high voltage electrode and at least one parallel, preferably essentially planar, counter electrode for the generation of a non-thermal plasma at atmospheric pressure in the open space between the two electrodes, and comprising of at least one treatment zone essentially in the form of a channel along an axis, wherein said axis is essentially perpendicular to the planes of the two electrodes, wherein the substrate particle loaded carrier gas stream is guided through the treatment zone along said axis, and wherein the process gas stream is guided through the open space between the two electrodes before entering the treatment zone.

Preferably, such a device comprises pairs of alternating high voltage electrodes and counter electrodes, which form a stack in the direction of said treatment axis. In the space between the electrodes, the process gas stream runs preferably in each plane in a multitude of symmetrically arranged, converging channels incorporated into a dielectric material, preferably in at least two channels, more preferably in at least four channels, even more preferably in at least eight channels per plane, whereas the channel length in the direction of said channel axis, i.e. the length of process gas flow path, is in the range of 0.1-300 mm, preferable from 1-100 mm, more preferable from 5-50 mm.

The treatment zone can be provided as one single hole or clearance of any shape through or between the electrodes, wherein the central axis of said hole or clearance, i.e. of the treatment zone, coincides with the axis defined by the hole/clearance in/between the multitude of electrodes. This through hole or aligned clearance (treatment zone) is preferably arranged vertically in order to take advantage of the gravitational force for particle transport.

A dielectric material is introduced at least single layered between the electrodes defining the flowpath of the process gas, whereas the dielectric material preferably is a polymer material, an epoxy resin, a glass or a ceramic, whereas it can be used as dielectric layer only and/or as an insulating casting of the plasma units.

The process gas stream can be guided through channels inserted between said electrodes, whose cross-sections can have a round, rectangular or square shape in a plane perpendicular to the flow direction, wherein preferably the height of the discharge channels is in the range from 10 μm to 10 mm and/or a wherein preferably the width of the discharge channels is in the range from 1 μm to essentially the full extent of the surface enclosing the treatment zone.

A stack of at least one essentially circular alternating electrodes (preferably terminated at both ends by an electrode defining the lower voltage potential) is provided, where in the inter-electrode space thereof the process gas stream (the number of interspaces corresponds to the number of plates minus one) is directed to a central treatment zone, which is provided as a central hole or clearance through or between all electrodes with its axis perpendicular to the electrode's plane, and wherein a multitude of annular, circumferential ducts is provided through which the process gas streams are introduced in radial direction from the space between said electrodes.

Generally speaking, the process gas or carrier gas can be fed at different positions to the treatment zone.

The process gas and/or the carrier gas stream can furthermore be loaded/enriched? by at least one liquid, evaporable, or gaseous monomer to initiate chemical reactions towards solid material formation in the gas phase or at substrate particle surfaces.

A monomer can furthermore be additionally introduced directly or indirectly by a third gas stream into the treatment zone.

A multitude of micro-channels can be arranged randomly around the treatment zone, preferably arranged equidistantly.

Typically, the treatment zone is cylindrical and has a characteristic/hydraulic diameter in the range of 2-100 mm, preferably in the range of 5-20 mm.

The treatment zone can furthermore be designed modularly in order to extend the length of the treatment zone and to increase the mean residence time of the substrate particles. The process gas composition of each module can preferably be changed independently to the other modules.

The process as defined above as well as a device as defined above can be used for example for the increase of the wettability and/or the surface energy of the said particulate materials or for any kind of functionalisation of the surface with organic or inorganic materials.

Further preferred embodiments of the present invention are defined in the dependent claims.

One of the fundamental ideas of the invention is thus to modify substrate particles in the remote afterglow of an atmospheric plasma by means of highly reactive species and independently of the plasma discharge mode. Conflictingly, these activated species are generated locally, e.g. in the case of filamentary discharges, in narrowly confined volumes with typical dimensions in the range from 10 to 100 μm. Due to short radical lifetimes at atmospheric pressure (typically 1-30 ms, see e.g. Eliasson, B., and Kogelschatz, U. (1991). "Non-equilibrium volume plasma chemical processing." IEEE Transactions on Plasma Science, 19 (6), 1063-77), the spatial distribution of these excited species is limited to their diffusion length, i.e. typically to the active plasma zone. With this respect, the inventive solution, which enables a remote treatment of substrate particles at atmospheric pressure, is to superimpose very high velocities upon the process gas (drift) in order to extend the displacement distance of the reactive species and thus, the afterglow region of the plasma. This approach allows spatially separating the plasma region from the substrate treatment zone at atmospheric pressure, thus avoiding the drawbacks related to the disadvantageous, direct plasma-particle interactions described above. In the treatment zone, the reactive process gas is admixed with the carrier gas, which is uniformly loaded with fully dispersed substrate particles. Here, the excited species carried by the process gas interact with the surfaces of the particulate solids to e.g. form functional groups at the surface. Despite short lifetimes of activated species at atmospheric pressure compared to those at low pressure, displacement distances of a few millimeters to centimeters can be achieved in high velocity flows allowing particles treatment devices with dimensions large enough to modify particles surfaces economically. Additionally, by limiting the characteristic dimension of the discharge volume to the sub millimeter range, the process gas consumption is maintained moderate while still reaching exit velocities in the order of Mach 0.8-1. At the same time, the required ignition voltage as well as the plasma burning voltage is considerably decreased, thus reducing the demands for the high voltage equipment The technical realization of the present invention depends strongly on the aspired properties of the treated substrate particles. One favoured embodiment is the circular arrangement of several micro-scaled plasma channels around the treatment zone. The length of the particle treatment zone is thus either determined by the effective radical lifetime or the number of consecutively positioned micro-scaled plasma channel arrays in axial direction. The mean residence time of the particles can be principally controlled by the overall gas flow (i.e. process gas and carrier gas flow comprising) or the number of transits through the treatment zone. The latter is strongly depending on the rector concept chosen. The most efficient one is where all substrate particles pass the treatment zone only once resulting in very short exposure times to the excited species. This is favourably realized in so-called plasma down-stream reactors (PDR, reference is made here to Arpagaus, C., Sonnenfeld, A., and von Rohr, P. R. (2005). "A downer reactor for short-time plasma surface modification of polymer powders." Chemical Engineering & Technology, 28 (1), 87-94). On the other hand, it might also be required that the particles are transported several times through the same treatment zone. In that case, the treatment zone is best positioned in the raiser tube of circulation fluidized bed reactor (reference is made here to Karches, M., and von Rohr, P. R. (2001). "Microwave plasma characteristics of a circulating fluidized bed plasma reactor for coating of powders." Surface and Coatings Technology, 142-144, 28-33). Drum reactors or fluidized bed reactors (see Park, S. H., and Kim, S. D. (1998). "Oxygen plasma surface treatment of polymer powder in a fluidized bed reactor." Colloids and Surfaces a-Physicochemical and Engineering Aspects, 133 (1-2), 33-39) are beneficially used when substrate particles have to remain in the treatment zone over a longer period of time (e.g. minutes, hours).

The favoured embodiment of the axial arrangement of a multitude of micro-scaled plasma channel arrays along the treatment zone also results in a continuous process gas flow from the micro-channel openings in the reactor wall to the centre of the treatment zone. The high process gas velocities at the openings result in an increased momentum transfer away from the reactor walls. This concept has already been applied in transpiring wall reactors to prevent clogging due to particle attachment. The same principle is applied in the favoured embodiment to aerodynamically focus the carrier gas to the centre of the reactor and thus reducing particle interactions with the sidewalls of the treatment zone.

The process of the present invention combines the following (technological) advantages:

- The surface energy of fine powders (e.g. polymers) can be increased efficiently in a continuous atmospheric pressure process, thus avoiding expensive vacuum installations. Furthermore, the process gas flow and to a certain extent the mass flow are not subject to restrictions as in the case of low pressure processes.
- Fully dispersed particles in a reactive environment can homogenously be treated, independent of the plasma discharge mode (e.g. filamentary or homogenous) applied for the generation of active species.
- Disadvantages resulting from the interaction between plasma and substrate particles can be avoided by the separation of the plasma and the treatment zone. These include the protection of the particle surface from direct ion-bombardment, i.e. surface heating, additional excessive particle charging, particle interaction with the electric field that leads to enhanced particle agglomeration, and plasma instabilities caused by direct plasma-particle interactions.
- The attachment of particles inside the treatment zone can additionally be reduced by introducing a constant process gas flow from the sidewalls making use of the main advantage of a transpiring wall reactor.
- Low operation temperature (<50° C.) allows treating temperature sensitive materials (e.g. polymers, pharmaceutical agents)
- Moreover, the favoured embodiment of the invention as described below can simply be scaled up by multiplying the number of remote plasma units to increase the reactor length and thus the residence time of the particles. By varying the carrier gas composition at different stages of the treatment zone the chemical composition of the modified surface can be controlled.

BRIEF DESCRIPTION OF THE DRAWINGS

For the better understanding of the invention and the favoured embodiment thereof, reference is made to the accompanying figures, whereas

DETAILED DESCRIPTION OF THE INVENTION

Figure 1:
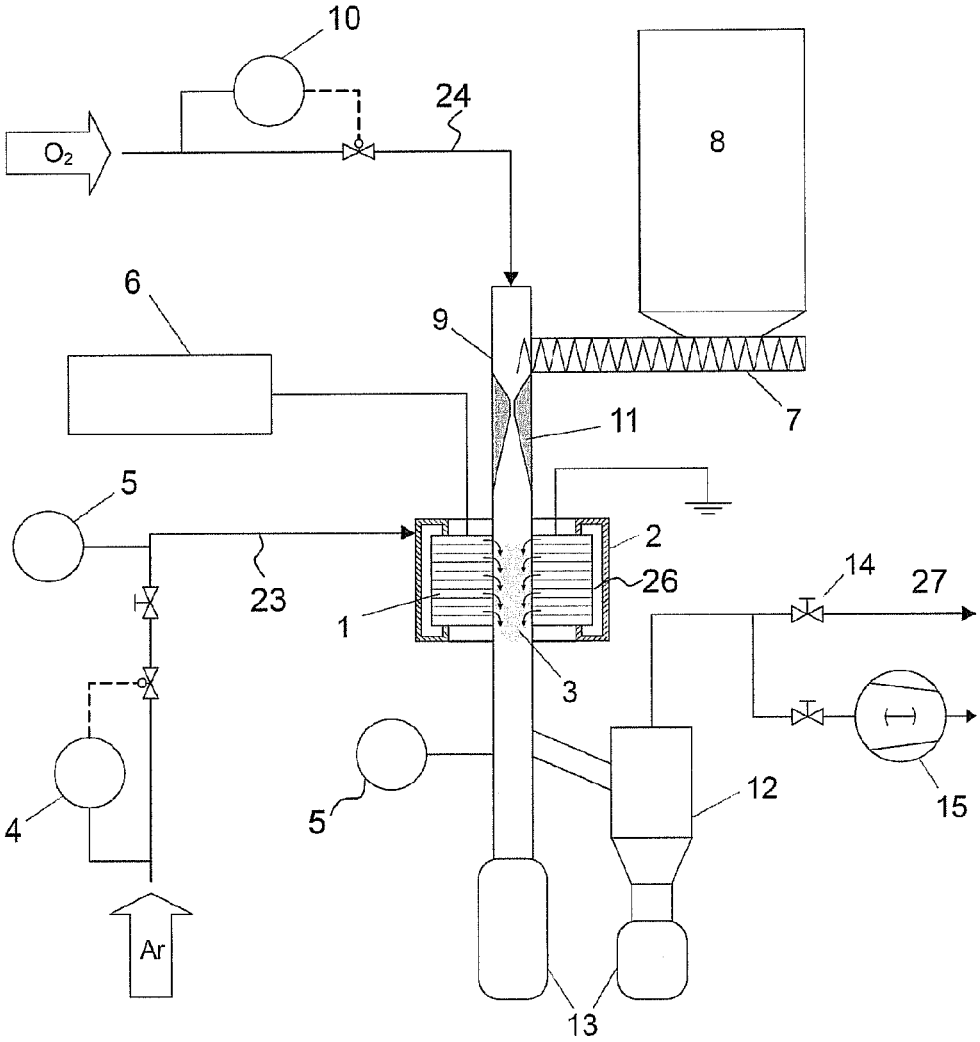
FIG. 1 illustrates the technical realization of a possible set-up for a powder processing apparatus as explained hereafter.

The process principle and the possible technical realization of the invention will be explained exemplarily on the basis of a PDR design, in which the benefits of short term processing and narrow residence time distribution can be reaped. A favoured embodiment of an apparatus for the continuous remote plasma particle treatment at atmospheric pressure implying the invented process is shown in FIG. 1. The main part of the set-up is a stack of individual plasma units 1 mounted inside a cylindrical hull, henceforth called plasma module 2. In the centre of the vertical arrangement, a cylindrical treatment zone 3 is located. Its length is depending on the number of plasma units embedded. The latter consists of a multitude of micro-channels, in which the atmospheric plasma is ignited. One possible embodiment of an individual plasma unit will be addressed in detail later. The process gas flow is supplied by a flow controller 4 from e.g. a pressurized bottle to the outer hull of the plasma module. Here, it is uniformly distributed over all plasma units. The pressure inside is monitored by a pressure indicator 5. The cylindrical hull could also be divided into several compartments, which are supplied by different flow controller in order to vary the gas composition along the inner treatment zone. The atmospheric discharge inside the plasma module can be powered by a commercial high voltage supply 6.

The untreated substrate particles are carried by a metering screw 7 from the storage container 8 to the main reactor tube 9. In the upper part of the tube, the particles are accelerated by the carrier gas stream, which is controlled by a second flow controller 10 and directly introduced from the top. By passing a diverging nozzle device 11, the substrate particles are homogeneously dispersed over the whole cross-section and transported through the treatment zone of the plasma module. Thereafter, the modified particles are again separated from the main gas flow by a cyclone 12 and recovered in solid collecting vessels 13. Optionally, the treatment zone can be slightly pressurized above atmospheric pressure by adjusting the exit valve 14 or a partial vacuum can be drawn within the treatment zone by a coarse vacuum pump 15.

Figure 2:
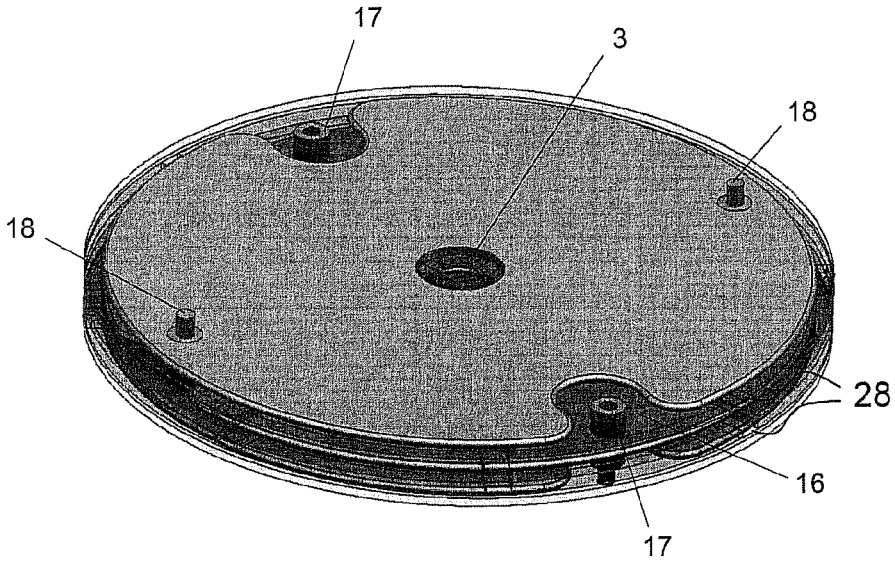
FIG. 2 illustrates a single plasma unit as embedded in the plasma module.

The plasma units mounted into the plasma module are the key elements for the generation of active species in the process gas flow. One favoured embodiment of a plasma unit is shown in FIG. 2. It is assembled by several subcomponents which are all embedded in an epoxy resin matrix 16 to guarantee high electric strength. In the centre of the disc-like plasma unit, the cylindrical channel of the treatment zone 3 is located. Four electrical plugs in total at the circumferential are needed to supply the middle electrode with high voltage (two HV plugs 17) and to connect the counter electrodes with the ground potential 18. They fit into each other in order to create a stack of several plasma units as installed in the plasma module.

Figure 3:
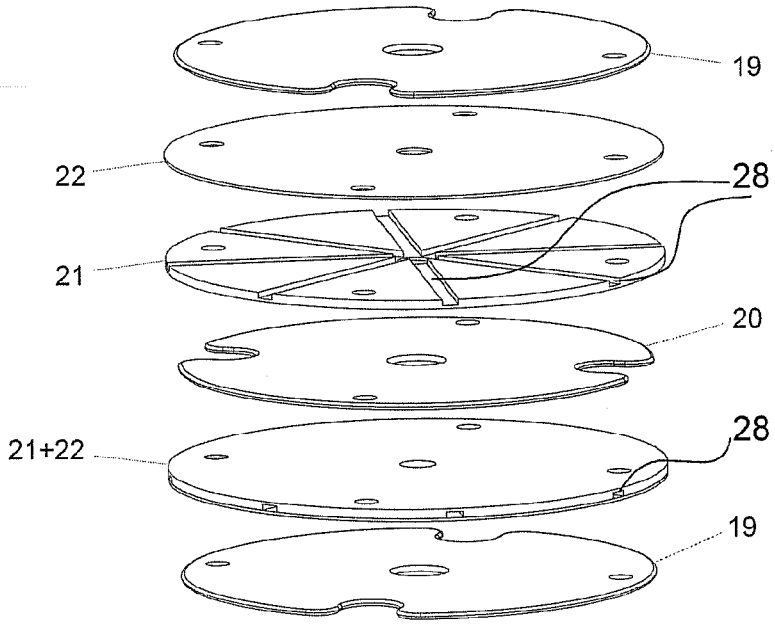
FIG. 3 shows an exploded view of a single plasma unit.
Figure 4:
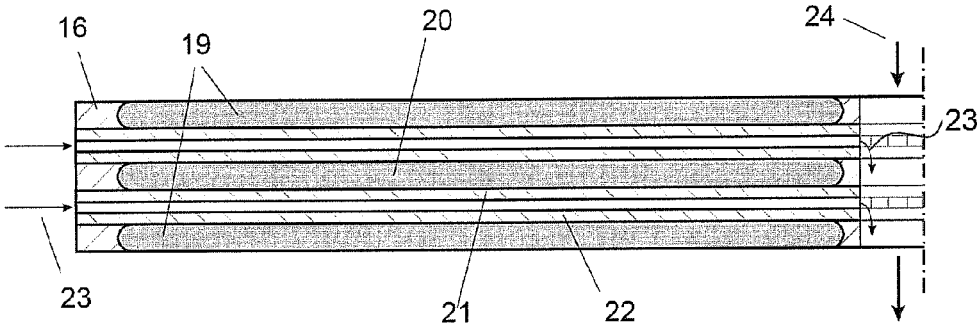
FIG. 4 is a lateral cross-section view of the plasma unit through one discharge channel in accordance with the preferred embodiment.

FIG. 3 shows the exploded view of the plasma unit with all subcomponents prior the addition of the epoxy resin. The components are arranged in typical sequence of a BD set-up. The two outmost aluminum sheets are interconnected by a metallic pin and represent the counter electrodes for the BD arrangement 19 (low voltage potential, preferably ground potential). The same design was used for the high voltage electrode 20, which is simply turned by 90 degrees to the ground electrodes. On both sides of the HV electrode, a thicker dielectric layer made of polymethyl methacrylate (PMMA) is introduced 21, in which a multitude of micro channels are incorporated. These channels are covered by a thinner PMMA layer 22 to create a symmetric dielectric barrier profile. All interfacial gaps are then filled with an epoxy resin casting of high dielectric strength. By exposing the composite structure to vacuum, the casting is completely degassed in order to achieve a high quality epoxy resin without micro-air bubbles. The cross-section view of the assembled plasma unit is illustrated in FIG. 4. The process gas 23 is introduced from the outer channel openings in the circumferences and then expanded into the inner vertically arranged treatment zone. The particle loaded carrier gas stream 24 flows perpendicularly from top to the bottom (down stream design).

Figure 5:
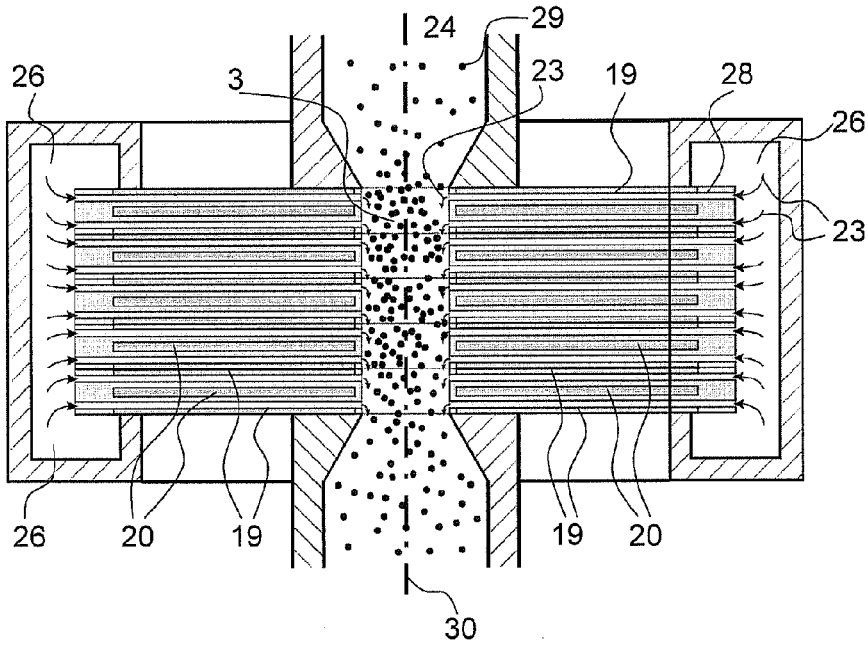
FIG. 5 an axial cut through a device including a stack of electrodes.

FIG. 5 shows exemplarily an axial cut through a full stack of plasma units forming a central treatment zone 3 which is defined by a central annular duct provided in each of the plates defining the electrodes 19, 20. Around this stack, a toroidal flow chamber 26 is provided, which serves to homogenously distribute the process gas 23 to all channel inlets of the different dielectric layers. Both topmost and bottommost electrodes 19 are at low potential (preferably ground) and directly connected to the toroidal flow chamber. The carrier gas stream 24 loaded with substrate particles 29 is essentially driven by gravitational and/or fluid dynamical forces along the central axes 30 through the treatment zone 3. The process gas 23 passes the electrode stack through the tiny channels 28 wherein the plasma is ignited/burning. The active plasma species are generated inside the plasma channels and forced by the high gas velocity of the process gas 23 present in said channels to mix with the carrier gas stream inside the treatment zone 3 where they react with the particles 29. After having leaved the treatment zone, the modified particles can be collected by conventional means.

Experimental Part

The proposed apparatus for the treatment of particulate substrates at atmospheric pressure was embedded into a down stream reactor originally designed for low pressure surface modifications. For the present first part of the investigation, however, this set-up has slightly been modified in order to introduce cylindrical samples instead of particulate materials, which enables faster parameter screening. All experiments were done using Polymethylmethacrylate (PMMA) cylinders with an outer diameter of 5.2±0.1 mm and a total length of 40 mm. They are concentrically positioned inside the treatment zone 3. A stack of individual plasma units is mounted inside a cylindrical hull, which guarantees sufficient mechanical strength for the pressurized gas feed and allows uniform distribution of the process gas to the inlet of the individual plasma channels (see FIG. 5). In the centre of this vertical arrangement, the aforementioned treatment zone 3 with an inner diameter of 10 mm is located. Its length is defined by the number of plasma units embedded. A single plasma unit consists of a ground 19 and a high voltage (HV) electrode 20 made of aluminium. In-between, a two-layer acrylic glass (PMMA) disc 21,22 is inserted as a dielectric barrier with a total thickness of 1.5 mm ($\in_r$=2.3). In one of these two layers 21, a total of eight micro-channels 28 are incorporated by conventional micro-machining. They are arranged such that each channel cross section is pointing towards the centre of the treatment zone 3. The second layer 22 is finally bonded using chloroform to etch and recombine the polymer surfaces and hence, allow a proper gas sealing. The resulting linear ducts size 2 mm×500 μm and have a total length of 40 mm. The effective discharge zone expands over approximately 35 mm inside the micro-channel 28. Typically, eight such plasma units are combined to form a discharge module (see FIG. 5). All subcomponents of these eight plasma units are embedded in an epoxy resin matrix, which provides electrical and mechanical strength. Finally, one discharge module is a solid epoxy block with a length of 22 mm that consists of several electrodes and a total of 64 plasma channels.

The sinusoidal high voltage (HV) signal at a frequency of 1 kHz is supplied by a waveform generator 6, amplified by a commercial audio amplifier and then transformed to a maximum peak-to-peak voltage of 25 $kV_{pp}$. The electrical operation parameters such as discharge current and charge transfer were monitored using a digital oscilloscope.

In a first step to evaluate the feasibility of the invented reactor design and its efficiency in remote surface treatment at atmospheric pressure, a study about the treatment time, the influence of gas composition, and the excess voltage is discussed here. The latter is defined as the voltage difference between the burning voltage and the applied voltage. The level of excess voltage $U_e$ is proportional to the overall transferred charge in μ-BDs and therefore an indication for the dissipated energy inside the discharge. The effect of the plasma treatment was characterized by dynamic water contact angle (WCA) measurements according to the Wilhelmy method. The corresponding contact angles for deionised water were obtained with a Krüss K100 tensiometer. The variation of contact angle measured of the same samples treated under the same conditions is ±1.5°. Contact angles of 79.8±1.3° and 76.9±1.5° have been measured for the untreated PMMA samples and those treated in pure He respectively.

Helium (He 99.99999% purity, PanGas) was used as process gas with admixtures of $O_2$, $N_2$ or $CO_2$ in the range from less than 1 to 30 Vol.-%. The total volume flow was kept constant at 20 nl/min, which results in an average gas channel velocity of 6 m/s. This value corresponds to the estimated velocity of the emerging activated gas species from the plasma channel array into the treatment zone. Therein, the gas velocity increases gradually over its absolute length of 22 mm from approximately 0.8 m/s to 6.5 m/s. The WCA was always determined as an averaged value over the last five millimeters of the cylindrical PMMA sample. The reactor pressure inside the treatment zone was maintained at 900 mbar using a course vacuum pump (Busch, MM 1142 BV). Consequently, the pressure at the inlet of the discharge channels varied between 930 and 960 mbar depending on the gas composition applied. The effect of the variation in pressure as well as the influence of the gas composition upon the burning voltage have been considered by using an excess voltage of $U_e$=1 kV for all measurements.

Results

In a first step to describe the effect of the remote plasma treatment on PMMA surfaces, the influence of the treatment time on the WCA for three different gas mixtures was investigated. In all cases, the admixture concentration was 10 Vol.-% and the excess voltage applied $U_e$=1 kV. Generally speaking, the WCA decreases exponentially with increasing treatment time. Regardless of the admixed gas component, the WCA finally approaches a saturation level for treatment times larger than 120 s. The lowest values obtained differ depending on the type of gas mixture considered, e.g. a contact angle of 59° could be reached for He/$CO_2$. In comparison with a direct DBD treatment of polypropylene (filamentary and glow discharge mode), the improvement of the WCA reveals the same trend and the treatment is comparably efficient in terms of treatment time in the remote plasma approach. The process efficiency can further be improved by increasing the excess voltage $U_e$ to 2 kV or above, which is directly coupled to a higher power input into the plasma and therefore to an enhanced transportation of charges in the micro-discharge. As a consequence, the treatment duration to achieve the same level of surface modification can be further reduced by increasing the excess voltage $U_e$.

The effect of the gas composition and the concentration of the admixing components on the WCA was determined. For concentrations higher than 25 Vol.-%, the required excess voltages for gas mixtures with $N_2$ and $CO_2$ exceeded the proven electrical strength of the reactor and were therefore not measured. Nevertheless, the obtained WCAs for these two gas components already indicate a certain saturation level above 10 Vol.-%, i.e. the WCA will not improve significantly for higher gas concentrations. A different behaviour could be observed for small amounts of $O_2$ admixed to He. In this case, the WCA drops rapidly to a minimum contact angle of 65° for small $O_2$ admixtures of 0.25 Vol.-% (2500 ppm). By further increasing the $O_2$ concentration, the activation of the surface becomes worse and remains at an elevated level around 72±1°.

The electric discharge characteristic monitored by the oscilloscope clearly shows the occurrence of filamentary BDs for admixtures of $O_2$ and $CO_2$. A single stationary discharge peak was observed for He/$N_2$ indicating the diffuse glow discharge mode. A remarkable effect on the WCA at the polymer surface attributed to the discharge mode was however not perceivable. Consequently, the surface modification inside the treatment zone seems indeed to be independent of the discharge mode.

Furthermore, an adapted screening of the gas composition can be beneficial. For instance, small amounts of $O_2$ admixed to the He discharge reduce the WCA further than $O_2$ concentrations higher than 5 Vol-%.

LIST OF REFERENCE NUMERALS

1 plasma units
2 plasma module
3 treatment zone
4 flow controller
5 pressure indicator
6 high voltage supply, HV-generator 1 kHz
7 metering screw
8 storage container
9 reactor tube
10 flow controller
11 second flow controller
12 cyclone
13 collecting vessels
14 exit valve
15 vacuum pump
16 epoxy resin matrix
17 HV plugs
18 ground potential
19 counter electrode, ground potential
20 high voltage electrode
21 dielectric layer
22 PMMA layer
23 process gas stream
24 carrier gas stream
25 carrier gas
26 circumferential duct
27 vent
28 channel
29 particles
30 axis of treatment zone 3

The invention claimed is:

1. A remote plasma process for the treatment of particulate materials comprising:

the step of providing a process gas stream enriched by active species, in that an electrical gas discharge is applied to the process gas stream for the creation of a non-thermal plasma at atmospheric pressure in a plasma zone, the electrons generated in the plasma being used to generate said active species in the process gas stream;

the step of superimposing high velocities upon the process gas stream enriched by active species in order to prolong the displacement distance of the active species and thus, enlarge an afterglow region of the said non-thermal plasma;

the step of providing a carrier gas stream loaded with substrate particles; and the step of mixing of said process gas stream enriched by active species and said carrier gas stream in a treatment zone, wherein the substrate particle treatment in the treatment zone is spatially and temporally separated from the production of said active species such that the treatment zone is located in the afterglow of the non-thermal plasma or downstream of the plasma zone;

wherein a homogenous, chemical reaction of the active species on the surface of the substrate particles takes place in said treatment zone;

wherein in said treatment zone the particle loaded carrier gas stream, optionally loaded with additional gases or gas admixtures introduced at different stages along the treatment zone, is guided along an axis of the treatment zone, wherein said process gas stream enriched with active species is guided to the treatment zone from a direction essentially perpendicular to said axis, or in a conical direction, in a converging manner, and is guided to the treatment zone in an essentially circumferential and circularly symmetric manner in several planes perpendicular to said axis;

wherein said process gas stream enriched with active species is guided to the treatment zone through a plurality of symmetrically arranged channels located in a plane perpendicular to said axis or in a conical direction, in a converging manner, a plurality of such planar arrangements of channels being arranged in several planes distanced from each other along said axis;

wherein said plurality of symmetrically arranged channels comprises a stack of alternating high voltage electrodes and counter electrodes, and wherein in the interspace between the electrodes the process gas stream travels; and wherein the treatment zone is provided as one single through hole in said electrodes, the central axis of said hole in the electrodes defining said axis of the treatment zone.

2. The process according to claim 1, wherein the substrate particles remain in the treatment zone, in the form of a drum reactor or a fluidized bed reactor.

3. The process according to claim 1, wherein the active species, which are produced in the plasma zone, are transported by a process gas flow with a mean velocity in the range of 1 to 300 m/s from the plasma zone to the treatment zone.

4. The process according to claim 3, wherein the gas velocity is achieved by restricting the plasma zone to the millimeter range.

5. The process according to claim 4, wherein the gas velocity is achieved by restricting the plasma zone to the micrometer range.

6. The process according to claim 5, wherein the plasma zone is confined to at least one slot with a height in the range of 100 um-5 mm or to at least one channel with such a height and a width in the range of 100 μm-10 mm.

7. The process according to claim 1, wherein the non-thermal plasma is generated by a barrier discharge, corona discharge, and/or a micro hollow discharge.

8. The process according to claim 1, wherein the voltage for the plasma generation is DC or AC, whereas in the AC case the frequency is in the range from low frequency to the radiofrequency.

9. The process according to claim 1, wherein a mean operating pressure inside the plasma zone is in the range from 0.5 to 50 bar.

10. The process according to claim 1, wherein the particles are fed batchwise or in a continuous mode.

11. The process according to claim 1, wherein the substrate particles are periodically carried through the treatment zone.

12. The process according to claim 1, wherein the active species, which are produced in the plasma zone, are transported by a process gas flow with a mean velocity in the range of 20 to 100 m/s from the plasma zone to the treatment zone.

13. The process according to claim 1, wherein the voltage for the plasma generation is AC, with a frequency in the range of 500 Hz-27 MHz.

14. The process according to claim 1, wherein the voltage for the plasma generation AC, with a frequency in the range of 1 kHz-20 kHz.

15. The process according to claim 1, wherein the mean operating pressure inside the treatment zone is in the range from 0.1 to 10 bar.

16. A device for carrying out a process for the treatment of particulate materials, said device comprising:

a plurality of high voltage electrodes and alternating parallel counter electrodes for the generation of a non-thermal plasma at atmospheric pressure in an interspace between said electrodes, wherein a treatment zone is provided along a central axis as one single through hole in said plurality of electrodes, said treatment zone being essentially in the form of a channel along said central axis, and wherein said central axis is essentially perpendicular to planes defined by said plurality of electrodes, wherein the interspace comprises a plurality of symmetrically arranged channels located in a plane perpendicular to said central axis or in a conical direction, a plurality of such planar arrangements of channels being arranged in several planes distanced from each other along said central axis, said process for the treatment of particulate materials comprising:

a step of providing a process gas stream enriched by active species, in that an electrical as discharge is applied in said interspace to the process gas stream before entering the treatment zone for the creation of a non-thermal plasma at atmospheric pressure in a plasma zone, the electrons generated in the plasma being used to generate said active species in the process gas stream;

a step of superimposing high velocities upon the process gas stream enriched by active species in order to prolong the displacement distance of active species and thus, enlarge the afterglow region of the said atmospheric plasma;

a step of providing a carrier gas stream loaded with substrate particles guided through said treatment zone along said central axis; and a step of mixing of said process gas stream enriched by active species and said carrier gas stream in said treatment zone, wherein the substrate particle treatment in the treatment zone is spatially and temporally separated from the production of said active species in said interspace such that the treatment zone is located in the afterglow of the non-thermal plasma or downstream of said interspace;

wherein a homogenous, chemical reaction of the active species on the surface of the substrate particles takes place in said treatment zone;

wherein in said treatment zone the particle loaded carrier gas stream, optionally loaded with additional gases or gas admixtures introduced at different stages along the treatment zone, is guided along said central axis, wherein said process gas stream enriched with active species is guided to the treatment zone through said interspace from a direction essentially perpendicular to said central axis, or in a conical direction, in a converging manner, and is guided to the treatment zone in an essentially circumferential and circularly symmetric manner in several planes perpendicular to said central axis;

wherein said process gas stream enriched with active species is guided to the treatment zone through said plurality of symmetrically arranged channels.

17. The device according to claim 16, wherein at least one layer of dielectric material is located between the electrodes defining said channels for the process gas in the interspace.

18. The device according to claim 16, wherein the process gas stream is guided through said channels between said electrodes in the form of micro-channels, and wherein the cross-sections of said micro-channels have round, rectangular or square shape in a plane perpendicular to the flow direction.

19. The device according to claim 16, wherein said plurality of high voltage electrodes and alternating parallel counter electrodes comprises a stack of at least three, essentially circular alternating electrodes.

20. The device according to claim 19, wherein an annular circumferential duct is provided by means of which the process gas stream is introduced in a radial direction into at least two of the interspaces between the electrodes.

21. The device according to claim 16, wherein the device comprises a stack of alternating high voltage electrodes and counter electrodes, and wherein in said interspace between the electrodes the process gas stream travels, in each plane in a multitude of symmetrically arranged converging channels, in at least eight channels per plane, wherein the height in the direction of said axis of the process gas pathway is in the range of 100 μm to-1 mm.

22. The device according to claim 16, wherein said treatment zone is provided as one single through hole along a central axis in the electrodes, wherein said through hole is arranged vertically.

23. The device according to claim 16, wherein at least one layer of dielectric material is located between the electrodes defining the flow path of the process gas, wherein the dielectric material is a polymer material, an epoxy resin, a glass or a ceramic, and is used as dielectric layers and/or an insulating casting.

24. The device according to claim 16, wherein the process gas stream is guided through said channels in the form of micro-channels between said electrodes, and wherein the cross-sections of said micro-channels have round, rectangular or square shape in a plane perpendicular to the flow direction, wherein the height of the channels is in the range from 10 μm to 10 mm, and/or a wherein the width of the channels is in the range from 1 μm to essentially the full extent of the surface enclosing the treatment zone.

25. The device according to claim 16, wherein said plurality of high voltage electrodes and alternating parallel counter electrodes comprises a stack of at least nine essentially circular alternating electrodes and wherein an annular circumferential duct is provided by means of which the process gas stream is introduced in a radial direction into at least one of the interspaces between the electrodes.

26. The device according to claim 16, wherein the treatment zone is provided as one single through hole in the electrodes, wherein the central axis of this hole in the plurality of electrodes defines said central axis of the treatment zone, wherein this through hole is arranged vertically.

* * * * *